US009771950B2

(12) United States Patent
Friedrichs et al.

(10) Patent No.: US 9,771,950 B2
(45) Date of Patent: Sep. 26, 2017

(54) IMPELLER PUMP

(71) Applicant: E.G.O. Elektro-Geraetebau GmbH, Oberderdingen (DE)

(72) Inventors: Joern Friedrichs, Bretten (DE); Tobias Albert, Kraichtal (DE); Volker Block, Bretten (DE)

(73) Assignee: E.G.O Elektro-Geraetebau GmbH, Oberderdingen (DE)

( * ) Notice: Subject to any disclaimer, the term of this patent is extended or adjusted under 35 U.S.C. 154(b) by 725 days.

(21) Appl. No.: 14/148,182

(22) Filed: Jan. 6, 2014

(65) Prior Publication Data

US 2014/0193247 A1 Jul. 10, 2014

(30) Foreign Application Priority Data

Jan. 10, 2013 (DE) ..... 10 2013 200 280

(51) Int. Cl.
*F04D 29/42* (2006.01)
*F04D 29/44* (2006.01)
*F04D 29/58* (2006.01)

(52) U.S. Cl.
CPC ..... *F04D 29/426* (2013.01); *F04D 29/586* (2013.01)

(58) Field of Classification Search
CPC .. F04D 29/588; F04D 29/5893; F04D 29/586; F04D 29/5866; F04D 29/42; F04D 29/44
USPC ..... 415/169.1, 169.2
See application file for complete search history.

(56) References Cited

U.S. PATENT DOCUMENTS 3,069,735 A * 12/1962 Toulmin, Jr. ..... C02F 1/02 165/156
4,420,160 A * 12/1983 Laham ..... F16J 15/38 277/306
4,810,174 A * 3/1989 Stuckey ..... F04D 29/628 415/912

(Continued)

FOREIGN PATENT DOCUMENTS

CN 101657137 A 2/2010
CN 101896112 A 11/2010

(Continued)

OTHER PUBLICATIONS

State Intellectual Property Office for the P.R.C., First Office Action and Search Report for Application No. 201410011606.5, Nov. 21, 2016, 7 pages, China.

*Primary Examiner* — Nathaniel Wiehe
*Assistant Examiner* — Brian O Peters
(74) *Attorney, Agent, or Firm* — Alston & Bird LLP

(57) ABSTRACT

An impeller pump has a pump casing including a pump chamber and an inlet and an outlet thereon and an impeller therein, and including a heating device for heating the conveyed medium, which heating device forms an external wall of the pump chamber. The pump chamber extends annularly around the impeller and away from the pump chamber floor, wherein the outlet leads off on a region of the pump chamber which, viewed in the axial direction of the impeller pump, is pointing away from the pump chamber floor. The cross-sectional area of the pump chamber decreases in the axial direction of the longitudinal center axis of the impeller pump away from the pump chamber floor toward the outlet by virtue of an obliquely inwardly inclined external wall.

10 Claims, 2 Drawing Sheets

(56) References Cited

U.S. PATENT DOCUMENTS

| | | | | |
|---|---|---|---|---|
| 5,011,371 | A * | 4/1991 | Gottemoller | F04D 29/444 415/211.1 |
| 5,813,758 | A * | 9/1998 | Delcourt | B01F 7/00191 162/243 |
| 7,287,536 | B2 * | 10/2007 | Steck | A47L 15/4225 134/107 |
| 8,245,718 | B2 | 8/2012 | Büsing et al. | |
| 8,733,375 | B2 * | 5/2014 | Classen | A47L 15/4206 134/10 |
| 9,145,901 | B2 | 9/2015 | Li et al. | |
| 2012/0224961 | A1 | 9/2012 | Weber et al. | |
| 2013/0287561 | A1 | 10/2013 | Block et al. | |
| 2013/0343882 | A1 | 12/2013 | Albert et al. | |

FOREIGN PATENT DOCUMENTS

| | | | | |
|---|---|---|---|---|
| CN | 102748329 | A | | 10/2012 |
| DE | 102007017271 | A1 | | 10/2008 |
| DE | 102011003464 | A1 | | 4/2012 |
| DE | 102010043727 | A1 | | 5/2012 |
| DE | 102011003467 | A1 | | 8/2012 |
| DE | 102011005138 | A1 | | 9/2012 |
| EP | 2150165 | B1 | | 10/2012 |
| EP | 2677178 | A2 | | 12/2013 |
| JP | 58-72699 | A | | 4/1983 |
| WO | WO2009077266 | | * | 6/2009 |

* cited by examiner

IMPELLER PUMP

CROSS-REFERENCE TO RELATED APPLICATIONS

This application claims priority to German Application No. 10 2013 200 280.7, filed Jan. 10, 2013, the contents of which are hereby incorporated herein in its entirety by reference.

TECHNOLOGICAL FIELD

The invention relates to an impeller pump for the conveyance of a medium.

BACKGROUND

From EP 2150165 B1 it is known to configure an impeller pump of this kind in highly integrated design for use in a dishwasher. Here an annular pump chamber of circular cylindrical shape, which surrounds an inlet into the pump chamber and an impeller disposed in the pump chamber, is provided, wherein an external wall of the pump chamber is formed by a heating device. At that end of the pump chamber which is remote from the impeller, or on an upper rim or cover of the pump casing, there is provided an outlet from the pump chamber, from which the heated and conveyed medium is discharged.

BRIEF SUMMARY

The object of the invention is to provide an impeller pump stated in the introduction, with which problems of the prior art can be eliminated and it is possible, in particular, to improve the heating of a medium conveyed by the impeller pump.

This object is achieved by an impeller pump. Advantageous and preferred embodiments of the invention are the subject of the further claims and are described in greater detail below. The wording of the claims is expressly based on the content of the description.

It is provided that the impeller pump has a pump casing comprising a pump chamber, inlet and outlet. In the pump chamber, an impeller is provided behind the inlet and in front of the outlet within the conveyance path of the medium. In addition, a heating device for heating the conveyed medium, which forms at least a part of an external wall of the pump chamber, is provided. The impeller is here disposed on or above a pump chamber floor. Starting therefrom, the pump chamber extends annularly around the impeller and away from the pump chamber floor, advantageously along the axial direction or the longitudinal center axis. Viewed in this axial direction of the impeller pump, the outlet is disposed on a region of the pump chamber which is pointing away from the pump chamber floor. This means that the medium to be conveyed and heated passes through the inlet into the pump chamber, is moved or conveyed by the impeller into the pump chamber and along the heating device. The conveyed and heated medium then passes out to the outlet from the pump chamber and the whole of the impeller pump.

According to the invention it is provided that the cross-sectional area of the pump chamber decreases in the axial direction of the longitudinal center axis of the impeller pump away from the pump chamber floor toward the outlet or in the direction of the outlet. As a result of this decrease in the cross-sectional area of the pump chamber, the flow velocity of the conveyed medium is increased downstream or in the direction of the outlet. In this way, on the one hand, an overheating of the heating device can be avoided. In addition, the conveyed medium can be optimally heated.

In an advantageous embodiment of the invention, the cross-sectional area of the pump chamber can decrease monotonously in the axial direction or along the longitudinal center axis of the impeller pump away from the pump chamber floor toward the outlet. Particularly preferably, it can decrease in a strictly monotonous manner, i.e. it has a steadily diminishing cross section. The decrease can be achieved by virtue of an oblique wall of the pump chamber, namely the internal wall and/or the external wall. An angle of the sloping wall of the pump chamber to the longitudinal center axis of the impeller pump can here be small, advantageously ranging from 3° to 25°, particularly advantageously from 5° to 15°.

In one embodiment of the invention, at least the external wall of the pump chamber is slanted or inclined inward at an appropriate angle. If the external wall of the pump chamber is formed substantially or completely by the heating device, then the latter can be tubular in configuration. It can advantageously be configured such that it tapers conically away from the pump chamber floor, and can thus produce the decrease in cross section or cross-sectional area. Preferably, the heating device or the external wall of the pump chamber is rotationally symmetrical to the longitudinal center axis. In this way, a favorable shape for an advantageous flow is achieved. In addition, good producibility is thus obtained.

In a further embodiment of the invention, it can be provided that not only can an external wall run obliquely to the longitudinal center axis or not only does it produce the decrease in cross-sectional area of the pump chamber, but also a radially inner internal wall of the pump chamber can be slanted. It is here advantageously slanted outward for a still smaller cross-sectional area. An angle can here lie within an aforementioned range.

Preferably, the internal wall of the pump chamber runs straight, so that it thus runs parallel to the longitudinal center axis of the impeller pump. The cross section which it forms, or its radius, should be the same, this should also apply to its shape.

In the tapered region of the heating device or wall of the pump chamber, an output per unit of area of the heating means can remain the same, so that, in this region, less heating output is generated in total on account of the reduced area. Alternatively, the output per unit of area can increase, advantageously by 5% to 25%, or even 50%. It can here be provided, for example, that in the axial direction of the pump an output per unit of height remains roughly the same for the heating device. In this way, an increased output per unit of area likewise exists close to the outlet from the pump chamber, and thus the conveyed medium is heated even more on account of the here cumulative effect of the increased flow velocity.

In an advantageous embodiment of the invention, the heating device can extend from the pump chamber floor to just before the axial height of the outlet. It here advantageously overtops the impeller, at least in the axial direction toward the outlet, advantageously by a multiple of the height of the impeller. In the axial direction away from the outlet, the heating device can likewise overtop the impeller somewhat, though in this case, advantageously, only slightly. In particular, heating means or a heating element of the heating device should in this direction overtop the impeller only slightly, since the conveyance of medium into this region is less.

The heating device or heating means or a heating element of the heating device should run around at least the major part of the pump chamber. Advantageously, this is at least 70%, particularly advantageously it runs fully around. A heating device should here be understood as both a support and heating means disposed thereon, or one or more heating elements. Heating means on the heating device is provided all over or distributed over an area, for example in strips or in fields. To this end, one or more heating elements which to the person skilled in the art are known, however, from the prior art and which advantageously are thin-film or thick-film heating elements, can be provided.

The heating means should be provided on that side of the heating device which lies outside the pump chamber. In this way, corrosion problems and insulation problems are avoided or are less and an electrical connection becomes easier.

In yet another embodiment of the invention, the inlet can reach into the pump chamber to just before the impeller. It can end at less than 50% of the height of the pump chamber in the axial direction, for example at about 20% or 30% to 40%. The inlet thus lies very close to the impeller. The pump chamber has essentially only, on the one hand, the region in which the impeller runs or which the impeller requires, and, on the other hand, the region which extends annularly around the impeller and adjoins the latter within the conveyance path of the medium.

These and further features emerge, other than from the claims, also from the description and the drawings, wherein the individual features can be realized respectively in isolation or in plurality in the form of subcombinations in an embodiment of the invention and in other fields, and can constitute advantageous and inherently patentable embodiments for which protection is here claimed. The division of the application into individual sections, as well as subheadings, does not limit the statements made under these in terms of their generality.

BRIEF DESCRIPTION OF THE SEVERAL VIEWS OF THE DRAWINGS

Illustrative embodiments of the invention are represented schematically in the drawings and are explained in greater detail below. In the drawings.

DETAILED DESCRIPTION

Figure 1:
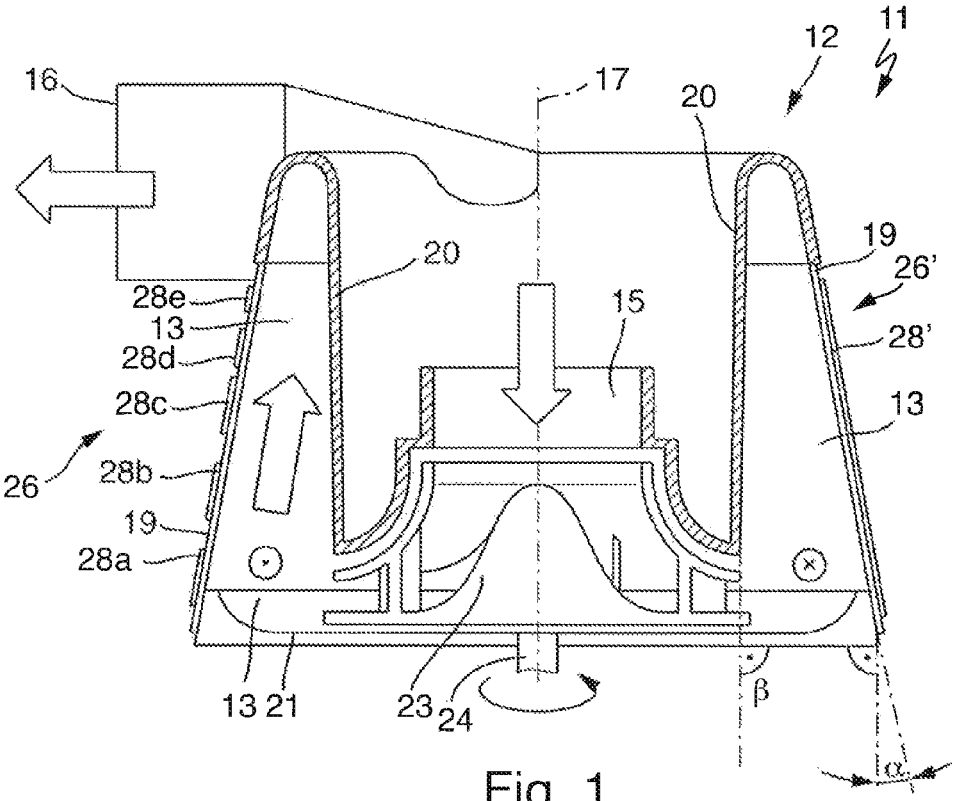
FIG. 1 shows a lateral sectional view through an inventive pump comprising a pump chamber tapered by a conical shape of an external wall.

In FIG. 1, an inventive impeller pump is represented in sectioned side view. The pump 11 has a pump casing 12, comprising a pump chamber 13. An inlet 15 leads into the center of the pump chamber 13 and an outlet 16 leads out at the upper rim. It can be seen that the inlet 15 is axially aligned with the longitudinal center axis 17 (shown in dashed representation), while the outlet 16, as is also shown by the top view from FIG. 3, runs at right angles thereto or tangentially to the circumferential pump chamber 13. The pump chamber 13 is limited in the downward direction substantially by an external wall 19 and an internal wall 20, as well as by a pump chamber floor 21. It can also be seen that the height of the pump chamber 13 in the axial direction has roughly four to six times the width of the pump chamber 13 close to the pump chamber floor 21, namely in the radial direction.

Just above the pump chamber floor 21 rotates an impeller 23, which reaches to close to the inlet 15 and is driven by a pump motor (not represented) via a motor shaft 24. The rotational direction of the impeller 23 is in FIG. 3 counter-clockwise and in FIG. 1 on the left of the impeller 23 out of the plane of the drawing and on the right into the plane of the drawing, as is represented by appropriate symbols. In this respect, the structure of the pump 11 substantially corresponds to the prior art stated in the introduction, in the form of EP 2150165. Liquid which is to be conveyed and heated, in particular water in a dishwasher, washing machine or the like, is introduced to the inlet 15 along the longitudinal center axis 17 and is discharged by the rotating impeller 23 in the radial direction, namely just above the pump chamber floor 21. The liquid has a circulating direction corresponding to the rotational direction of the impeller 23. At the same time, it rises further and further upward in the pump chamber 13, mainly along the external wall 19, until it finally after several revolutions, advantageously three to ten revolutions, is fed out to the outlet 16. In the pump chamber, it is hereupon warmed. This is respectively illustrated by the three arrows, wherein the arrow in the pump chamber 13 shows only the upward motional component and not the predominant motional component in the circulating direction in the pump chamber.

Figure 3:
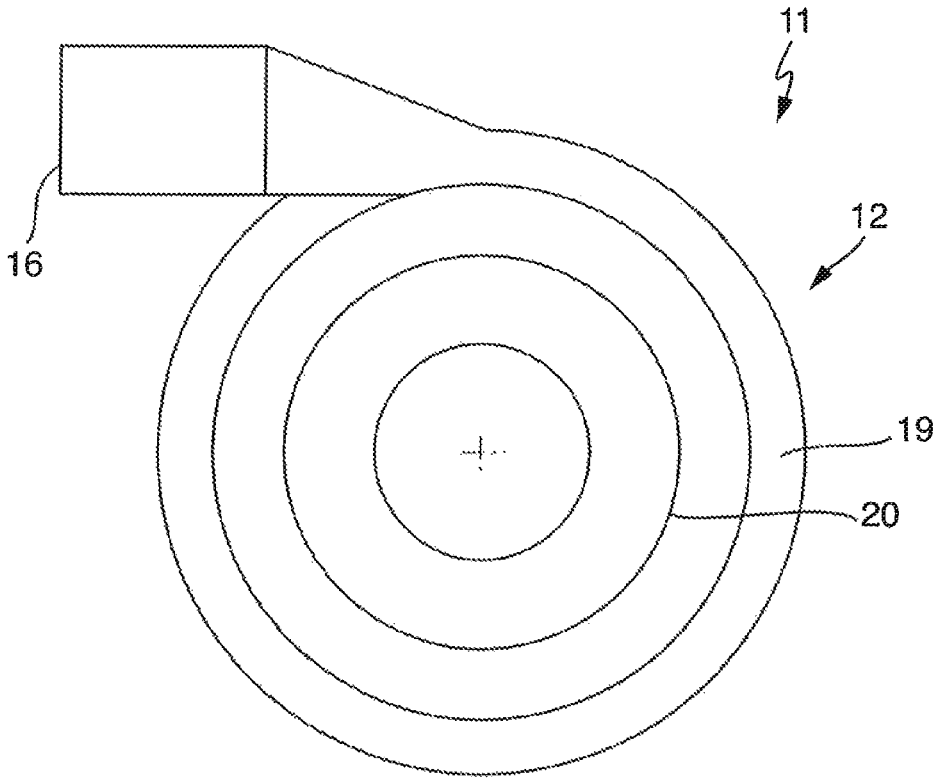
FIG. 3 shows a top view of the pump from FIG. 1.

Since the pump casing 12 according to FIG. 3 is substantially, except for the outlet 16, of rotationally symmetrical configuration, it is evident that the cross section of the pump chamber 13, which along the circulating direction at an axial height is always the same, tapers from the pump chamber floor 21 or from the impeller 23 and toward the outlet 16. In particular, the width of the pump chamber 13 right at the top beneath the apex or just in front of the outlet 16 amounts to only about 40% of the width at the height of the impeller 23. This is therefore a significant reduction in the cross-sectional area of the pump chamber. Here it can also be seen that the internal wall 20 stands at right angles to the plane of the pump chamber floor 21, and the angle $\beta$ between its course and the perpendicular to the pump chamber floor 21 or to the longitudinal center axis 17 measures 0°. The internal wall 20 also runs straight.

The external wall 19 likewise runs straight, but stands at an angle $\alpha$ of about 10° to the perpendicular to the pump chamber floor 21. Thus the external wall 19 is tilted inward or slanted by $\alpha$=10°.

It can further be seen that the internal wall 20 is configured in one piece with the inlet 15, as well as with the upper region of the pump casing 12, configured virtually as a cover, from which also the outlet 16 leads off in one piece. This part is advantageously made of plastic. The largest region of the external wall 19 (also referred to herein as outer wall 19) is configured as a heating device 26, as is fundamentally known also from the external wall of EP 2150165. There, however, the heating device is of circularly cylindrical and straight configuration, i.e. of constant cross-sectional area, which is specifically not the case here. The heating device 26 represented on the left in FIG. 1 has a support as part of the external wall 19, which support advantageously consists of metal or a special steel. On its outer side, as is known, once again, from the prior art, it is at least partially provided with an insulation, to which, once again, heating elements are applied. In the case of the heating device 26 represented on the left, these are heating elements **28*a* to 28*e*, which are configured, for example, as broadly circumferential resistance strips, advantageously in a thick-film heating element. They can be electrically connected to one another in parallel. It can be seen that the width of the heating elements 28 decreases away from the pump chamber floor 21 toward the outlet 16, and thus the heat generation in the upward direction increases due to the cumulative effect of heating elements 28***a* to 28*e*.

On the right in FIG. 1, a heating device 26' comprising a planar heating element 28' is represented. This is meant primarily to illustrate that here, unlike on the left side, the output per unit of area in the direction away from the pump chamber floor 21 remains the same for the heating device 26'.

The principal technical effect of the decrease in cross-sectional area or the tapering of the pump chamber 13 from bottom to top consists in the fact that here the flow velocity is increased. This promotes a heat removal from the heating device 26. Specifically in connection with the heating device 26 (represented on the left) with upwardly increasing output per unit of area of the heating means, this is of advantage. In this way, a better heating of the conveyed medium or of the conveyed liquid can be achieved without local overheating of the heating device 26.

It can be seen that the external wall 19 is formed above the heating device 26 by the plastics part of the pump casing 12. A sealed connection between these two parts is easily realizable for the person skilled in the art, for example by means of rubber seals. Although the heating device 26 could also be extended still higher, there are then, however, design problems on account of the outlet 16. In similar form, a seal can also be made between the lower region of the heating device 26 or 26' and the pump chamber floor 21.

Figure 2:
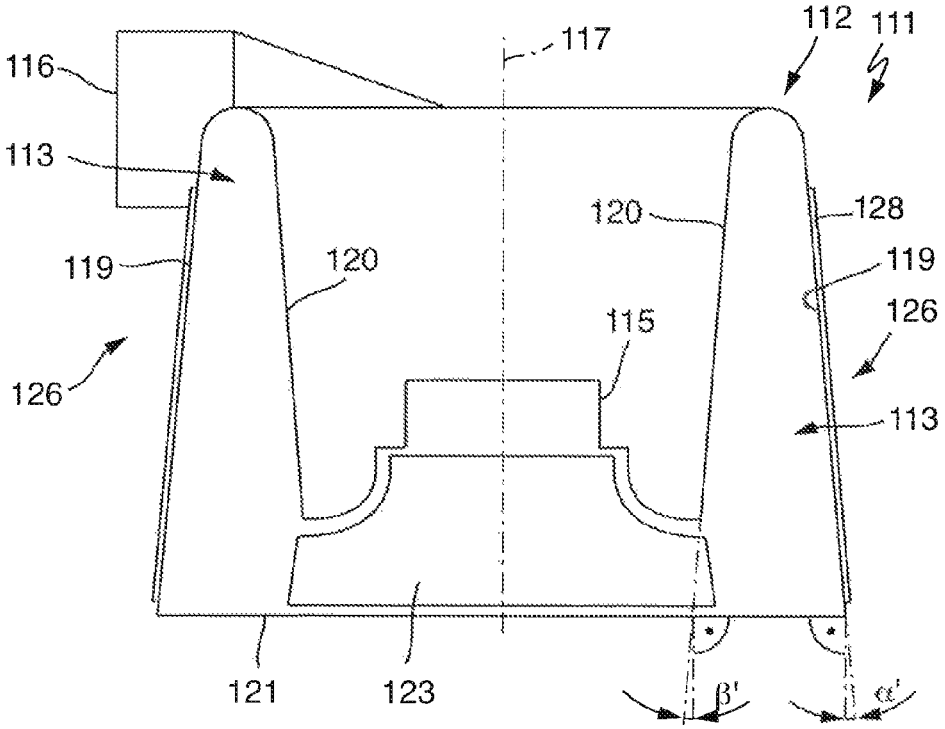
FIG. 2 shows a variation of the pump from FIG. 1, comprising a pump chamber tapered by a conical shape of internal wall and external wall.

In the variation of the invention as a pump 111 according to FIG. 2 (shown in simplified representation), a pump casing 112 comprising a pump chamber 113 is once again provided, as well as an inlet 115, an outlet 116 and a longitudinal center axis 117 (shown in dashed representation). An external wall 119 is once again slanted relative to the longitudinal center axis 117 or to a pump chamber floor 121. However, it can here clearly be seen that the angle $\alpha'$ is smaller than in FIG. 1 and advantageously is only 5°. Here too, however, an internal wall 120 of the pump casing 112 is obliquely inclined, namely obliquely outward. An angle $\beta'$ here likewise measures 5° in accordance with the angle $\alpha'$, though this is not absolutely necessary. Likewise, as a result, a pump chamber 113 of, in the direction away from the pump chamber floor 121, reduced cross-sectional area, i.e. an upwardly tapered pump chamber 113, is thereby obtained.

With respect to the heating device 126, as a large part of the external wall 119 of the pump chamber 113, a planar heating element 128 is shown in purely general representation. For this heating element 128, the same design options as in FIG. 1, or even yet further options, can apply.

The top view of the pump 11 according to FIG. 1, which is represented in FIG. 3, is meant essentially to illustrate to what extent the pump 11 or the pump casing 12 without the outlet 16 is of rotationally symmetrical, i.e. circular configuration. This applies above all to the external wall 19 and the internal wall 20. This rotational symmetry is not essential, however, though it is simple and advantageous for the manufacture of the pump, in particular as regards the manufacture of the heating device 26 as a fundamental component of the external wall 19.

That which is claimed:

1. An impeller pump for the conveyance of a medium, comprising:

a pump casing comprising a pump chamber and an inlet and an outlet thereon;

an impeller, disposed in said pump chamber, behind said inlet and before said outlet within a conveyance path; and a heating device to heat said conveyed medium, said heating device forming at least part of an external wall of said pump chamber, wherein said impeller is arranged on a pump chamber floor and, starting therefrom, said pump chamber extends annularly around said impeller and away from said pump chamber floor, and wherein said outlet leads off on a region of said pump chamber which, viewed in an axial direction of the impeller pump, is pointing away from said pump chamber floor, wherein a cross-sectional area of said pump chamber decreases continuously in said axial direction of a longitudinal center axis of said impeller pump away from said pump chamber floor and toward said outlet, and wherein said outlet runs in a direction at right angles to said axial direction, wherein said heating device is tubular in configuration, and wherein said heating device is rotationally symmetrical to said longitudinal center axis, wherein it is configured such that it tapers conically away from said pump chamber floor.

2. The impeller pump according to claim 1, wherein said decrease is uniform, with an angle of an oblique external wall of said pump chamber to said longitudinal center axis of said impeller pump from 3° to 25°.

3. The impeller pump according to claim 2, wherein said angle of said oblique external wall of said pump chamber to said longitudinal center axis of said impeller pump ranges from 5° to 15°.

4. The impeller pump according to claim 1, wherein a radially inner wall of said pump chamber runs straight and parallel to said longitudinal center axis of said impeller pump, and with constant radius.

5. The impeller pump according to claim 4, wherein said radially inner wall of said pump chamber has constant shape.

6. The impeller pump according to claim 1, wherein said heating device runs around at least a major part of said pump chamber.

7. The impeller pump according to claim 6, wherein said heating device runs fully around said pump chamber.

8. The impeller pump according to claim 1, wherein an output per unit of area of said heating device, viewed over a basic region of said heating device, is the same.

9. The impeller pump according to claim 1, wherein said heating device lies on a side outside said pump chamber.

10. The impeller pump according to claim 1, wherein said inlet ends at less than 50% of a height of said pump chamber in said axial direction.

* * * * *